US008168874B2

(12) United States Patent
Watson

(10) Patent No.: US 8,168,874 B2
(45) Date of Patent: May 1, 2012

(54) DRUMSTICK GRIPPING AID

(76) Inventor: Ronald Keith Watson, Riverside, CA (US)

( * ) Notice: Subject to any disclaimer, the term of this patent is extended or adjusted under 35 U.S.C. 154(b) by 236 days.

(21) Appl. No.: 12/756,821

(22) Filed: Apr. 8, 2010

(65) Prior Publication Data

US 2010/0257992 A1 Oct. 14, 2010

Related U.S. Application Data

(60) Provisional application No. 61/167,675, filed on Apr. 8, 2009.

(51) Int. Cl.
*G10D 13/02* (2006.01)

(52) U.S. Cl. ..... 84/422.4

(58) Field of Classification Search ..... 84/422.4, 84/453

See application file for complete search history.

(56) References Cited

U.S. PATENT DOCUMENTS 7,435,889 B1 * 10/2008 Heidt ..... 84/422.4
2009/0007755 A1 * 1/2009 Rivers, Jr. ..... 84/422.4

* cited by examiner

*Primary Examiner* — Kimberly Lockett
(74) *Attorney, Agent, or Firm* — Loza & Loza LLP; Heidi L. Eisenhut

(57) ABSTRACT

The present invention is directed to a drumstick gripping aid. In one embodiment, the drumstick gripping aid includes a first strap having two loops and a second strap having one loop interconnected thereto. The first strap is adapted to fit about at least two fingers of a user while the second strap is adapted to fit about an outer circumference of a drumstick. In another embodiment, a drumstick gripping aid includes a single strap having two loops. In one variation, a first loop is adapted to fit about one finger of a user while a second loop is adapted to fit about an outer circumference of a drumstick. In another variation, the first loop and the second loop are adapted to fit about at least two fingers of a user, the drumstick gripping aid fixedly attached to a drumstick.

18 Claims, 4 Drawing Sheets

DRUMSTICK GRIPPING AID

CLAIM OF PRIORITY

The present Application for Patent claims priority to U.S. Provisional Application No. 61/167,675 entitled "Drumstick Gripping Aid", filed Apr. 8, 2009, and is hereby expressly incorporated by reference herein.

FIELD OF THE INVENTION

At least one feature pertains to a gripping aid designed to hold drumsticks.

BACKGROUND OF THE INVENTION

A great number of people enjoy drums and drumming as their instrument of choice when it comes to music. Drums are a part of all music, from classical to rock and ancient to contemporary, as it forms the rhythm and thus basis for all music. Generally, drums are played by repeatedly striking a drumhead with a drumstick. While such an action sounds basic, it is not without its nuances. First, the mechanical action of hitting a drumhead requires that one plays the drum for extended periods of time. As a result, various aches, pains, and even repetitive stress injuries can occur. Second, drumsticks are prone to being dropped during play, resulting in a disjointed performance that is less than stellar. Finally, drummers are in a continuous search for a means of displaying stage presence, such as by twirling their drumsticks. However, this twirling is exceedingly difficult and if the drumsticks should be dropped during such a display, the drummer runs the risk of exposing himself to ridicule.

Consequently, a device which addresses the problems as previously described is needed.

SUMMARY

The present invention is directed to a drumstick gripping aid for holding drumsticks in order to reduce muscle stress and/or strain, substantially or completely eliminate stick dropping and/or slippage, and increase drumstick twirling ability. In one embodiment, the drumstick gripping aid comprises a first strap, having a first loop and a second loop approximately situated within the same plane and adapted to position about two fingers of a user, and a second strap having a single loop interconnected, and situated approximately perpendicular, to the first strap at a median portion thereof. The second strap further comprises a neck portion, having a first end and a second end, extending through an opening in the median portion of the first strap, the single loop attached to the first end of the neck portion and a retaining pin attached to the second end of the neck portion for retaining the first strap to the second strap.

In another embodiment, a drumstick gripping aid includes a first strap interconnected to a second strap through an opening in the first strap. The first strap includes a single (or first) loop to fit about one finger of a user and the second strap includes a single (or second) loop, adapted to fit about an outer circumference of a drumstick. First strap may be positioned approximately degrees relative to second strap, or vice-versa.

BRIEF DESCRIPTION OF THE DRAWINGS

Various features, nature and advantages may become apparent from the detailed description set forth below when taken in conjunction with the drawings in which like reference characters identify correspondingly throughout.

DETAILED DESCRIPTION

The following detailed description is of the best currently contemplated modes of carrying out the invention. The description is not to be taken in a limiting sense, but is made merely for the purpose of illustrating the general principles of the invention.

Embodiments of the invention are directed to grip assist devices or drumstick gripping aids (hereinafter used interchangeably) and methods of use thereof. In one embodiment, a drumstick gripping aid includes a first strap having two loops and a second strap having one loop interconnected thereto. The two loops of the first strap are adapted to fit about at least two fingers of a user while the second strap is adapted to fit about an outer circumference of a drumstick. In another embodiment, a drumstick gripping aid includes a first strap, having a single first loop adapted to fit about one finger of a user, and a second strap having a single second loop adapted to fit about an outer circumference of a drumstick. The drumstick gripping aid according to embodiments of the invention is designed to hold drumsticks in order to reduce muscle stress and/or strain, substantially or completely eliminate stick dropping and/or slippage, and increase drumstick twirling ability.

Figure 1:
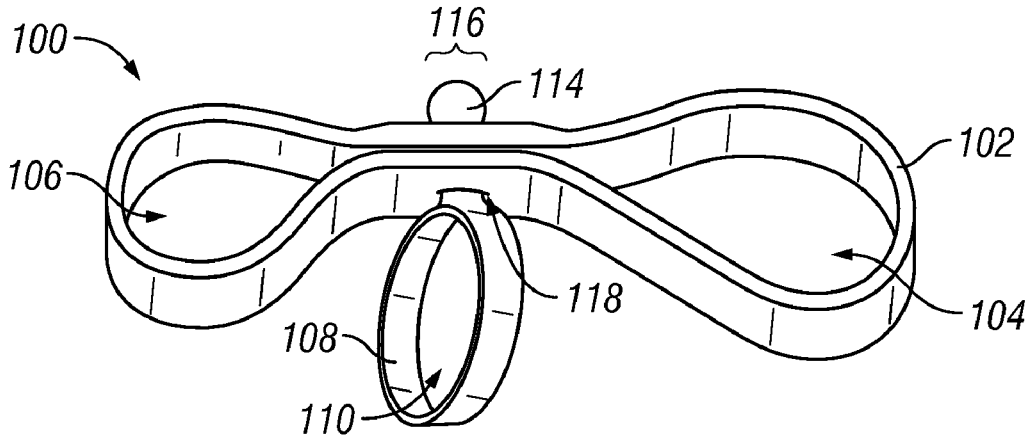
FIG. 1 illustrates a perspective view of a drumstick gripping aid according to an embodiment of the invention.

FIG. 1 illustrates a perspective view of a drumstick gripping aid according to an embodiment of the invention. As shown, drumstick gripping aid 100 includes a first strap 102 having a first loop 104 and a second loop 106 interconnected to a second strap 108 having a single loop 110, a neck portion (not shown, see FIGS. 2C-2D, neck portion 212) and a retaining pin 114. Second strap 108 may be interconnected to first strap 102 at a median portion 116 of first strap 102. In one embodiment, an opening 118, which includes two openings (not shown, see FIGS. 2A-2B, 218*a* and 218*b*), passes through median portion 116 of first strap 102. Opening 118 is configured to retain second strap 108 at neck portion. More particularly, in the case in which retaining pin 114 is approximately ball-shaped, retaining pin 114 may have a larger circumference relative to a circumference of opening 118. As a result, once retaining pin 114 and neck portion of second strap 108 pass (or extend) through opening 118, second strap 108 is interconnected to first strap 102 and substantially or completely retained thereto. Additionally, the passing through of second strap 108 through opening 118 forms first and second loops 104, 106 of first strap 102.

Figure 2A:
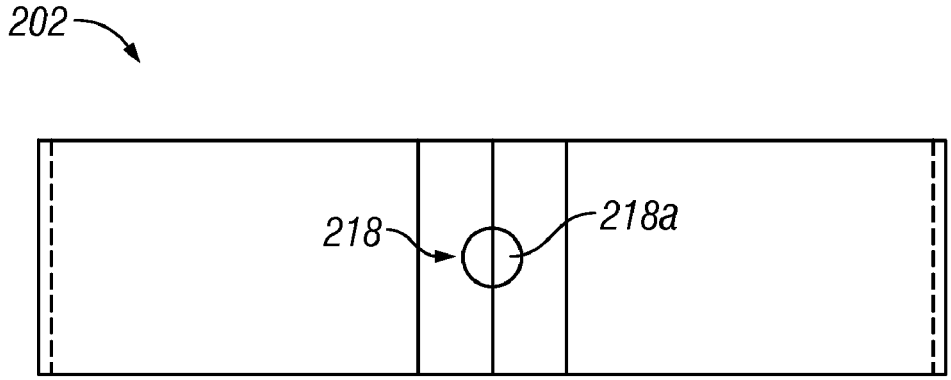
FIG. 2A illustrates a top view of a first strap of a drumstick gripping aid according to an embodiment of the invention.

FIG. 2A illustrates a top view of a first strap of a drumstick gripping aid according to an embodiment of the invention. First strap 202 may have a flattened loop configuration; however, other suitable configurations are within the scope of the invention. In the embodiment shown, first strap 202 has a flattened loop configuration having a top portion 202*a* and a bottom portion 202*b* (not shown, see FIG. 2B). First strap 202 may have a length of between about two (2) inches and about five (5) inches, preferably approximately about three (3) inches. First strap 202 may have a width of between about one-half (½) of an inch and about two (2) inches, preferably about three-fourths (¾) of an inch. In any embodiment, the width of first strap 202 should be wide enough to provide adequate support for a user's fingers (explained in more detail below) yet sufficiently narrow so as not to interfere with the user's fingers (explained in more detail below). Similarly, the length of first strap 202 should be long enough to provide at least two loops to comfortably fit about a user's fingers (explained in more detail below) yet sufficiently short so as to provide a gripping function (explained in more detail below). First strap 202 includes an opening 218 which includes openings 218*a* (on top portion 202*a*) and 218*b* (on bottom portion 202*b*, see FIG. 2B) at a median portion 216 of first strap 202. Opening 218 may have a diameter of between about one-tenth (1/10) of an inch and about one-half (½) of an inch, preferably about one-fifth (⅕) of an inch.

Figure 2B:
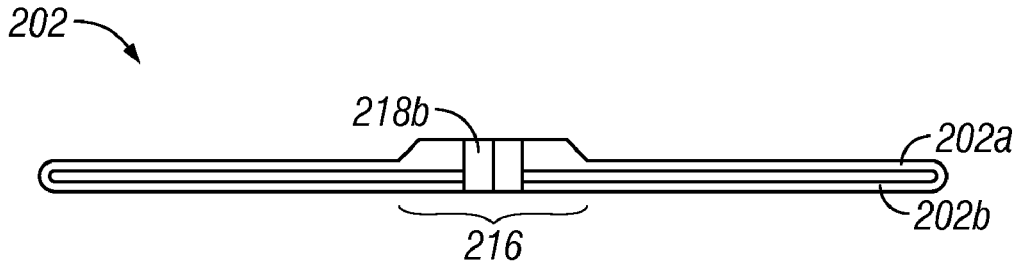
FIG. 2B illustrates a side view of the first strap of FIG. 2A.

FIG. 2B illustrates a side view of first strap 202 of FIG. 2A. According to this embodiment, median portion 216 of top portion 202*a* of first strap 202 is thicker relative to the remaining portions of first strap 202. This feature provides added reinforcement to drumstick gripping aid. More particularly, the thicker median portion 216 stiffens the area around opening 218 to substantially or completely retain a second strap therethrough (see FIG. 2C). Additionally, the thicker median portion 216 substantially or completely reduces enlargement of opening 218 which may occur during repeated use of drumstick gripping aid 200. Also shown in FIG. 2B is bottom portion 202*b* of first strap 202 and opening 218, i.e., openings 218*a*, 218*b*.

Figure 2C:
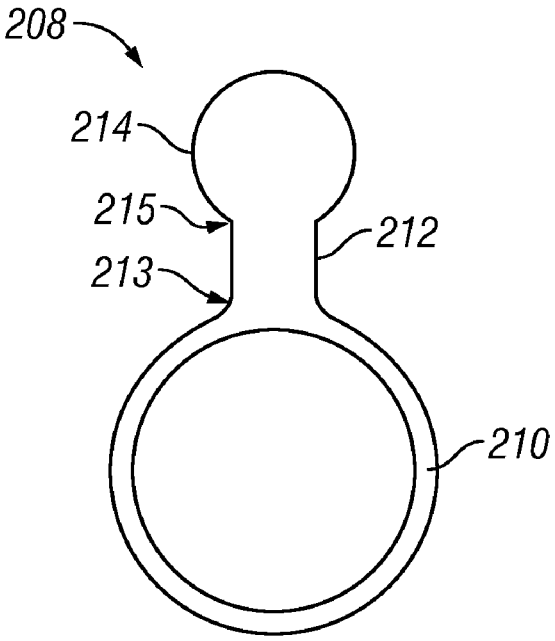
FIG. 2C illustrates a front view of a second strap of a drumstick gripping aid according to an embodiment of the invention.
Figure 2D:
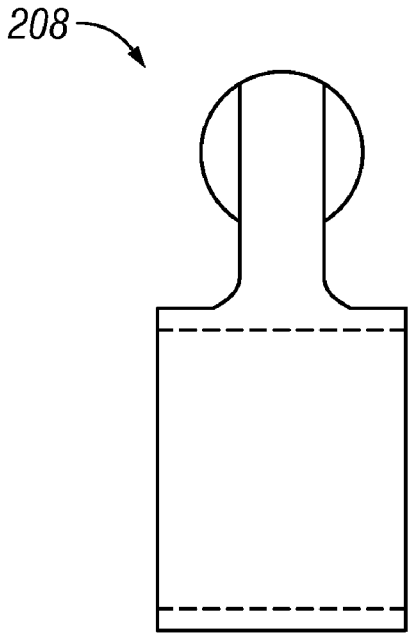
FIG. 2D illustrates a side view of the second strap of FIG. 2C.
Figure 2E:
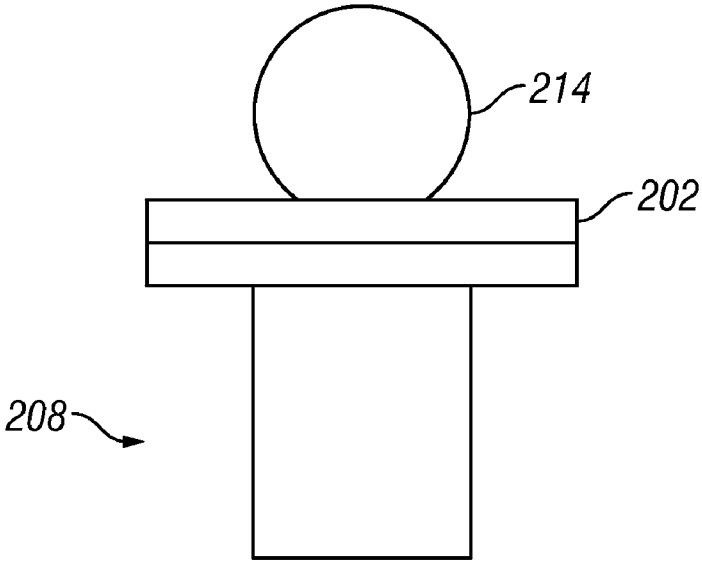
FIG. 2E illustrates a side view of a drumstick gripping aid having the first strap and the second strap interconnected.

FIG. 2C illustrates a front view of a second strap of a drumstick gripping aid according to an embodiment of the invention. As shown, second strap 208 includes a loop portion 210, a neck portion 212, having a first end 213 and a second end 215, and a retaining pin 214. Loop portion 210 may have a diameter of between about 0.25 inches and about one (1) inch, preferably about one-half (½) of an inch and is integrally connected to the first end 213 of the neck portion 212. In any embodiment, loop portion 210 should have a diameter suitable for fitting about an outside circumference of a drumstick. Neck portion 212, which may have a cylindrical configuration, may have a thickness of about 0.125 inches. In any embodiment, neck portion 212 should have a smaller diameter relative to a diameter of opening 218 of first strap 202 (see FIG. 2B). Retaining pin 214, which may have a ball-like configuration, may have a diameter of about 0.25 inches at its thickest portion and is integrally connected to the second end 215 of the neck portion 212. In any embodiment, retaining pin 214 should have a larger diameter relative to a diameter of opening 218 of first strap 202 (see FIG. 2B). FIG. 2D illustrates a side view of second strap 208 of FIG. 2C. FIG. 2E illustrates a side view of a drumstick gripping aid having first strap 202 and second strap 208 interconnected as previously described.

Generally, a drumstick gripping aid according to embodiments of the invention may be manufactured by methods such as rubber extrusion and cutting, plastic injection molding and mass production assembly techniques such as those known by one of ordinary skill in the art. For example, in one embodiment, both first strap 202 and second strap 208 may be made of rubber or any other suitable material with similar characteristics to that of rubber. In another embodiment, second strap 208 may be made of a combination of rubber and plastic materials. For example, loop portion 210 may be of a rubber material while neck portion 212 and/or retaining pin 214 may be made of a plastic material or a rubber material.

Figure 3B:
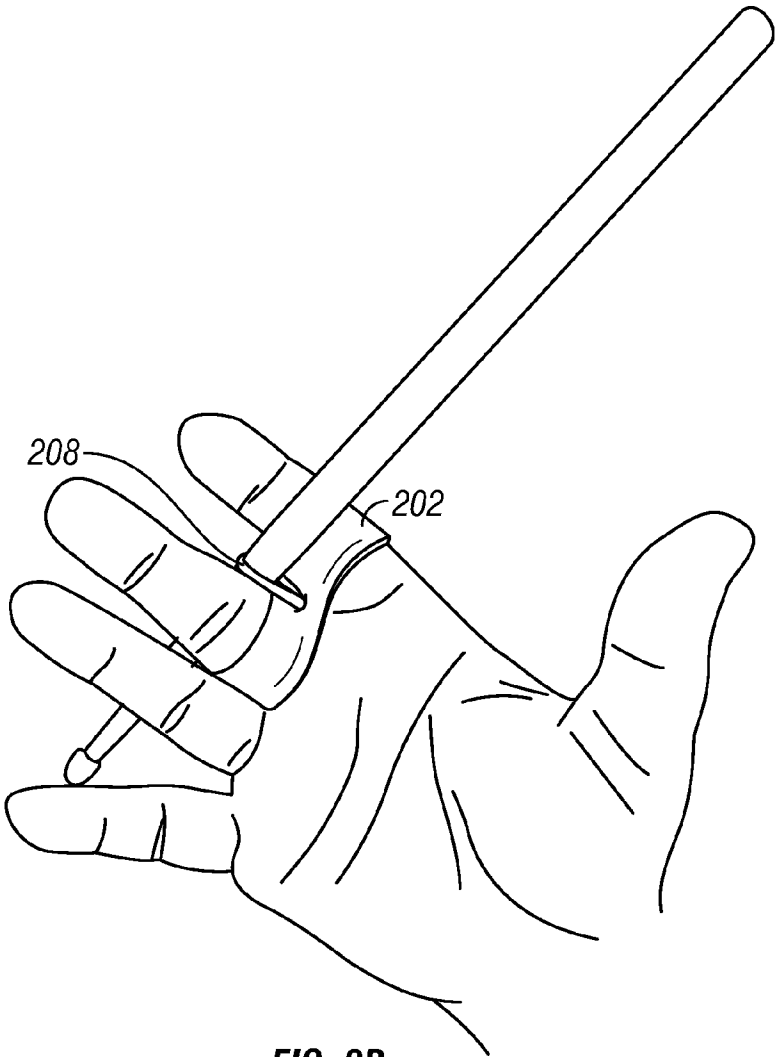
FIG. 3B illustrates a bottom view of a drumstick gripping aid of FIG. 1 secured to a drumstick and a hand of a user.
Figure 3A:
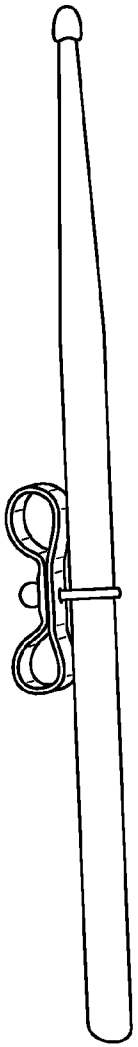
FIG. 3A illustrates a side view of a drumstick gripping aid of FIG. 1 secured to a drumstick.

According to embodiments of the invention as previously described, a drumstick gripping aid may provide a means by which drumsticks can be carefully and comfortably held while simultaneously increasing playing ability, duration and visual expression without the disadvantages as described in the Background of Invention. According to one method, a user may position the second strap 208 of the drumstick gripping aid on a drumstick (see FIG. 3A) followed by positioning of the first strap 202 on at least two adjacent fingers (preferably the index and middle fingers) of the hand of the user (see FIG. 3B); or vice-versa. This process may be repeated for a second drumstick/second hand. As a result, the drumstick(s) is/are free to move about in the user's hands, yet the drumstick(s) is/are tightly tethered to the user's hand if the user's grip partially or completely opens and/or relaxes. Additionally, the drumstick can be easily twirled about by the user due to the pivoting arrangement provided by the drumstick griping aid without fear of dropping it. Additional benefits include relief of fatigue build-up in fingers; increased relaxation of the hand; and better stick control resulting in less broken drumsticks. Moreover, it is anticipated that the drumstick gripping aid according to embodiments of the invention will not affect the performance of the sound of the drums.

Figure 4A:
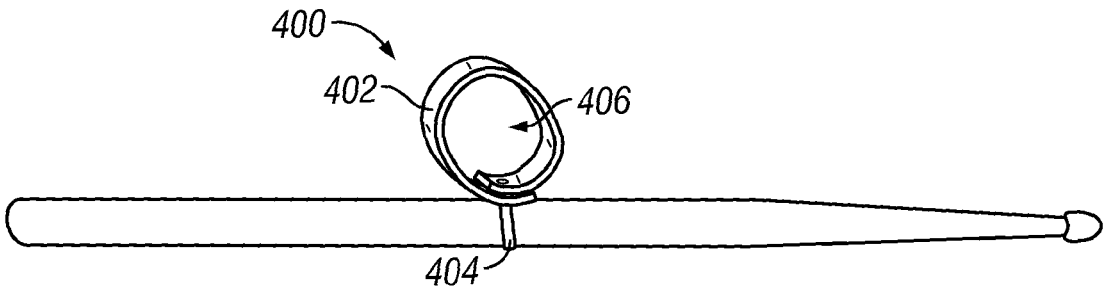
FIG. 4A illustrates a side view of a drumstick gripping aid, secured to a drumstick, according to an embodiment of the invention.
Figure 4B:
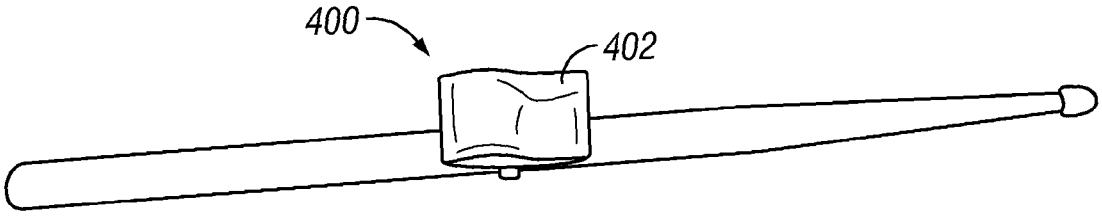
FIG. 4B illustrates a top view of the drumstick gripping aid of FIG. 4A.

FIGS. 4A-4B illustrate a drumstick gripping aid according to an alternative embodiment of the invention. As shown, a drumstick gripping aid 400 includes a first strap 402 interconnected to a second strap 404 through an opening in the first strap 402. The first strap 402 includes a single (or first) loop 406 adapted to fit about one finger of a user and the second strap 404 includes a single (or second) loop, adapted to fit about an outer circumference of a drumstick 408. First strap 402 may be positioned approximately 90 degrees relative to second strap 404, or vice-versa. Both first strap 402 and second strap 404 may be made of rubber or any other suitable material with similar characteristics to that of rubber.

One or more of the components and functions illustrated in FIGS. 1-4B may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A drumstick gripping aid, comprising:

a first strap having a first loop and a second loop; and a second strap having a single loop and interconnected to the first strap at a median portion of the first strap, wherein the second strap is situated approximately perpendicular relative to the first strap.

2. The drumstick gripping aid of claim 1 wherein the second strap is interconnected to the first strap via an opening through the median portion of the first strap.

3. The drumstick gripping aid of claim 1 wherein the median portion of the first strap has a thickness greater than a thickness of a remaining portion of the first strap.

4. The drumstick gripping aid of claim 2 wherein the second strap further comprises a neck portion integrally connected to the single loop and a retaining pin integrally connected to the neck portion.

5. The drumstick gripping aid of claim 4 wherein the neck portion has a circumference less than a circumference of the opening and the retaining pin has a circumference greater than the circumference of the opening.

6. The drumstick gripping aid of claim 1 wherein a material comprising the gripping aid is elastic.

7. The drumstick gripping aid of claim 1 wherein the first loop is adapted to position about a finger of a user and the second loop is adapted to position about a drumstick.

8. The drumstick gripping aid of claim 1 wherein the first loop and the second loop are approximately situated within the same plane.

9. The drumstick gripping aid of claim 4 wherein the retaining pin is ball shaped.

10. The drumstick gripping aid of claim 4 wherein the neck portion has a cylindrical configuration.

11. The drumstick gripping aid of claim 1 wherein the second strap further comprises:

a neck portion having a first end and a second end and extending through the median portion of the first strap, the single loop integrally connected to the first end of the neck portion; and a retaining pin integrally connected to the second end of the neck portion for retaining the first strap to the second strap.

12. The drumstick gripping aid of claim 1 wherein the first loop and the second loop are adapted to position about two fingers of a user.

13. A drumstick gripping aid, comprising:

a first strap having a first loop and a second loop; and a second strap comprising:

a single loop interconnected to the first strap at a median portion of the first strap wherein the second strap is situated approximately perpendicular relative to the first strap;

a neck portion having a first end and a second end and extending through the median portion of the first strap, the single loop integrally connected to the first end of the neck portion; and a retaining pin integrally connected to the second end of the neck portion for retaining the first strap to the second strap.

14. The drumstick gripping aid of claim 13 wherein the first loop and the second loop are approximately situated within the same plane.

15. The drumstick gripping aid of claim 13 wherein the first loop and the second loop are adapted to position about two fingers of a user.

16. The drumstick gripping aid of claim 13 wherein a material comprising the gripping aid is elastic.

17. The drumstick gripping aid of claim 13 wherein the retaining pin is ball shaped.

18. The drumstick gripping aid of claim 13 wherein the neck portion has a cylindrical configuration.

* * * * *